US010978001B2

(12) United States Patent
In et al.

(10) Patent No.: US 10,978,001 B2
(45) Date of Patent: Apr. 13, 2021

(54) PIXEL OF A DISPLAY PANEL HAVING A PANEL DEVIATION COMPENSATION VOLTAGE AND DISPLAY DEVICE

(71) Applicant: Samsung Display Co., Ltd., Yongin-si (KR)

(72) Inventors: Hai-Jung In, Seoul (KR); Naoaki Komiya, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/550,073

(22) Filed: Aug. 23, 2019

(65) Prior Publication Data

US 2020/0105199 A1 Apr. 2, 2020

(30) Foreign Application Priority Data

Oct. 1, 2018 (KR) ..... 10-2018-0116790

(51) Int. Cl.
*G09G 3/3258* (2016.01)
*G09G 3/3291* (2016.01)

(52) U.S. Cl.
CPC ..... *G09G 3/3258* (2013.01); *G09G 3/3291* (2013.01); *G09G 2300/0866* (2013.01)

(58) Field of Classification Search
CPC ..... G09G 3/3258
USPC ..... 345/204
See application file for complete search history.

(56) References Cited

U.S. PATENT DOCUMENTS 9,837,023 B2 12/2017 Kishi et al.
2014/0218415 A1* 8/2014 Pak ..... G09G 3/3291 345/690
2015/0294626 A1* 10/2015 Bi ..... G09G 3/3233 345/211

FOREIGN PATENT DOCUMENTS

| | | | |
|---|---|---|---|
| JP | 2006-276254 | A | 10/2006 |
| KR | 10-0509760 | B1 | 8/2005 |
| KR | 10-2010-0059316 | A | 6/2010 |
| KR | 10-1008438 | B1 | 1/2011 |
| KR | 10-1288596 | B1 | 7/2013 |

* cited by examiner

*Primary Examiner* — Long D Pham
(74) *Attorney, Agent, or Firm* — Lewis Roca Rothgerber Christie LLP

(57) ABSTRACT

A pixel of a display panel includes a storage capacitor, at least one scan transistor to transfer first and second voltages to ends of the storage capacitor in response to a scan signal, a driving transistor to generate a driving current based on a difference between the first voltage and the second voltage stored in the storage capacitor, at least one emission transistor to selectively provide the driving current to an organic light emitting diode in response to an emission control signal, and the organic light emitting diode to emit light, wherein the first voltage is a sum of a data voltage and a pixel deviation compensation voltage for compensating a threshold voltage deviation between pixels included in the display panel, and wherein the second voltage is a panel deviation compensation voltage for compensating a threshold voltage deviation between display panels manufactured by a same process for the display panel.

18 Claims, 20 Drawing Sheets

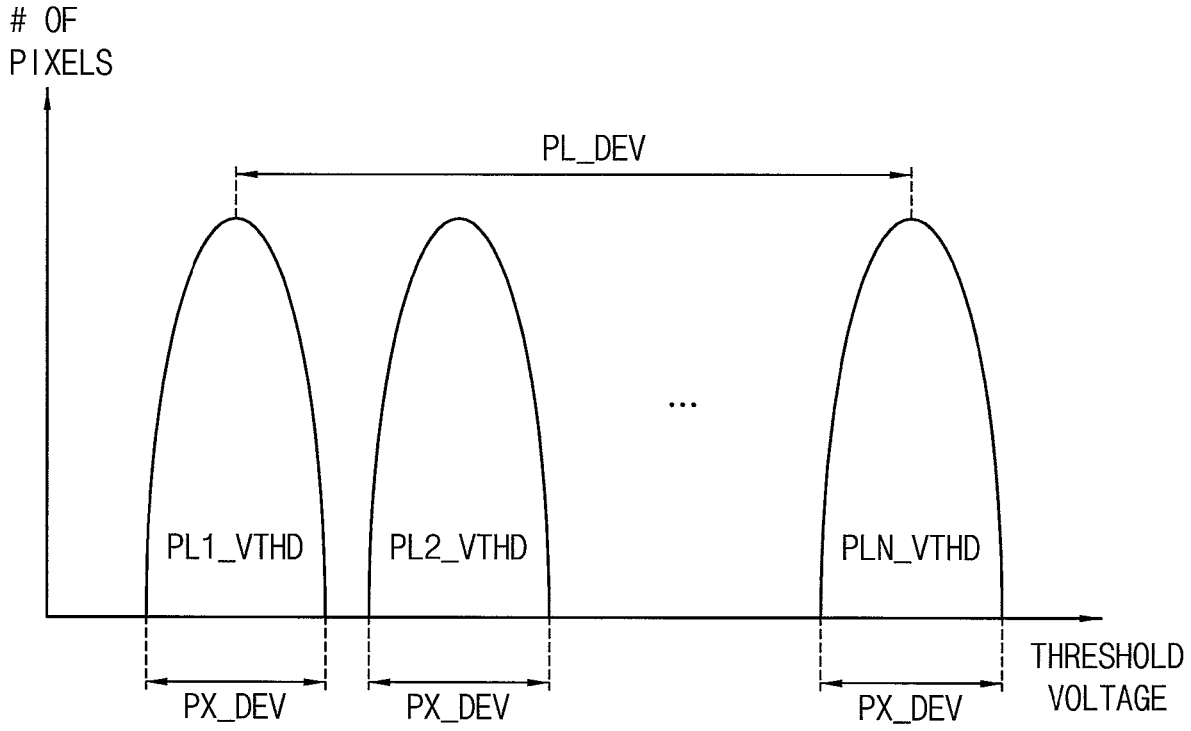
FIG. 3
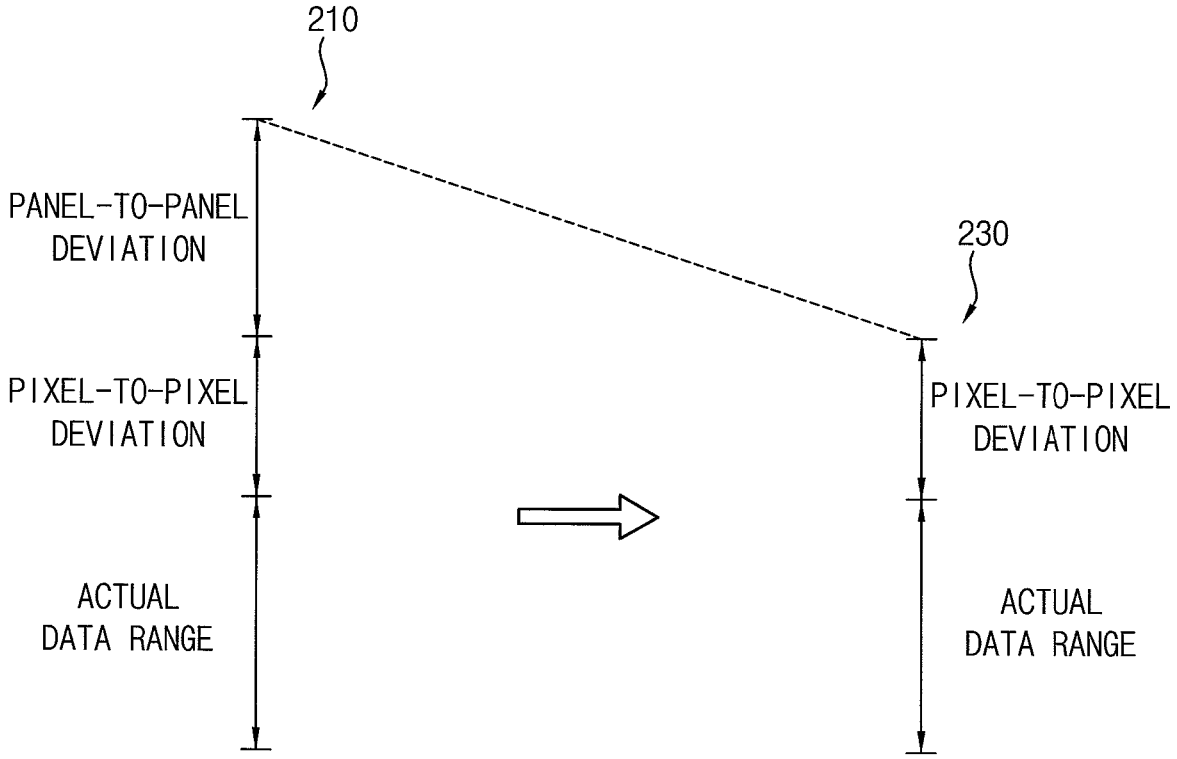

PIXEL OF A DISPLAY PANEL HAVING A PANEL DEVIATION COMPENSATION VOLTAGE AND DISPLAY DEVICE

CROSS-REFERENCE TO RELATED APPLICATION(S)

This application claims priority to, and the benefit of, Korean Patent Application No. 10-2018-0116790, filed on Oct. 1, 2018 in the Korean Intellectual Property Office (KIPO), the contents of which are incorporated herein in its entirety by reference.

BACKGROUND

1. Field

Embodiments disclosed herein relate generally to pixels of display panels, and to display devices including the pixels.

2. Description of the Related Art

Although a plurality of pixels in the same display panel may be manufactured by the same process, driving transistors of the plurality of pixels may have different threshold voltages. That is, the plurality of pixels in the same display panel may have a threshold voltage variation or deviation. In addition, although a plurality of display panels are manufactured by the same process, the respective display panels may have different threshold voltage distributions. That is, the plurality of display panels manufactured by the same process (e.g., lot-to-lot or glass-to-glass) also may have the threshold voltage variation or deviation.

To compensate for the threshold voltage variation/deviation between pixels in the same display panel and to compensate for the threshold voltage variation/deviation between display panels, an internal compensation method where each pixel compensates for the threshold voltage deviation, and an external compensation method where a data driver provides a voltage for compensating for the threshold voltage deviation in addition to a data voltage, have been developed.

The internal compensation method may require a complicated pixel structure because each pixel may include one or more additional transistors for compensating for the threshold voltage deviation/variation, and may also have a disadvantage that each frame period may include a threshold voltage compensation period. The external compensation method may not require the complicated pixel structure, and may also have an advantage that the threshold voltage compensation period is not required. However, in the external compensation method, because the data driver should cover a wide voltage range to compensate for not only the threshold voltage deviation/variation between pixels, but also the threshold voltage deviation/variation between display panels, a cost and power consumption of the data driver may be increased.

SUMMARY

Some embodiments provide a pixel of a display panel in which a threshold voltage variation or deviation between pixels and a threshold voltage variation or deviation between display panels are compensated using different voltages.

Some embodiments provide a display device compensating for a threshold voltage variation or deviation between pixels and a threshold voltage variation or deviation between display panels using different voltages.

According to some embodiments, there is provided a pixel of a display panel, including a storage capacitor, at least one scan transistor configured to transfer a first voltage and a second voltage to respective ends of the storage capacitor in response to a scan signal, a driving transistor configured to generate a driving current based on a difference between the first voltage and the second voltage stored in the storage capacitor, at least one emission transistor configured to selectively provide the driving current to an organic light emitting diode in response to an emission control signal, and the organic light emitting diode configured to emit light based on the driving current, wherein the first voltage is a sum of a data voltage and a pixel deviation compensation voltage for compensating for a threshold voltage deviation between a plurality of pixels included in the display panel, and wherein the second voltage is a panel deviation compensation voltage for compensating for a threshold voltage deviation between a plurality of display panels manufactured by a same process for the display panel.

The panel deviation compensation voltage may be a same voltage for the plurality of pixels included in the display panel.

The panel deviation compensation voltage for each of the plurality of display panels may be determined based on an average value or a median value of a threshold voltage distribution of the each of the plurality of display panels.

The panel deviation compensation voltage may be determined when the display panel is manufactured.

The at least one scan transistor may include a first scan transistor configured to transfer the first voltage to a first end of the storage capacitor, which is connected to a gate of the driving transistor, in response to the scan signal, and a second scan transistor configured to transfer the second voltage to a second end of the storage capacitor in response to the scan signal.

The first scan transistor may include a gate for receiving the scan signal, a drain for receiving the first voltage, and a source connected to the first end of the storage capacitor, and the second scan transistor may include a gate for receiving the scan signal, a drain for receiving the second voltage, and a source connected to the second end of the storage capacitor.

The at least one emission transistor may include a first emission transistor configured to connect the second end of the storage capacitor to a source of the driving transistor in response to the emission control signal, and a second emission transistor configured to connect a line of a first power supply voltage to a drain of the driving transistor in response to the emission control signal.

The first emission transistor may include a gate for receiving the emission control signal, a drain connected to the second end of the storage capacitor, and a source connected to the source of the driving transistor, and the second emission transistor may include a gate for receiving the emission control signal, a drain connected to the line of the first power supply voltage, and a source connected to the drain of the driving transistor.

The at least one emission transistor may include a first emission transistor configured to connect the second end of the storage capacitor to a source of a second emission transistor in response to the emission control signal, and the second emission transistor configured to connect a source of the driving transistor to both a source of the first emission transistor and the organic light emitting diode in response to the emission control signal.

The first emission transistor may include a gate for receiving the emission control signal, a drain connected to the second end of the storage capacitor, and the source connected to the source of the second emission transistor, and the second emission transistor may include a gate for receiving the emission control signal, a drain connected to the source of the driving transistor, and the source connected to the source of the first emission transistor and the organic light emitting diode.

The at least one emission transistor may include a first emission transistor configured to connect the second end of the storage capacitor to a source of the driving transistor in response to the emission control signal, and a second emission transistor configured to connect the source of the driving transistor to the organic light emitting diode in response to the emission control signal.

The first emission transistor may include a gate for receiving the emission control signal, a drain connected to the second end of the storage capacitor, and a source connected to the source of the driving transistor, and the second emission transistor may include a gate for receiving the emission control signal, a drain connected to the source of the driving transistor, and a source connected to the organic light emitting diode.

The at least one scan transistor may include a first scan transistor configured to transfer the second voltage to a first end of the storage capacitor, which is connected to a gate of the driving transistor, in response to the scan signal, and a second scan transistor configured to transfer the first voltage to a second end of the storage capacitor in response to the scan signal.

The first scan transistor may include a gate for receiving the scan signal, a drain for receiving the second voltage, and a source connected to the first end of the storage capacitor, and the second scan transistor may include a gate for receiving the scan signal, a drain for receiving the first voltage, and a source connected to the second end of the storage capacitor.

At least one of the at least one scan transistor, the driving transistor, and the least one emission transistor may include an NMOS transistor.

At least one of the at least one scan transistor, the driving transistor, and the least one emission transistor may include a PMOS transistor.

According to some embodiments, there is provided a display device including a display panel including a plurality of pixels, a scan driver configured to apply scan signals to the plurality of pixels, an emission driver configured to apply emission control signals to the plurality of pixels, a data driver configured to apply first voltages to the plurality of pixels, and a panel deviation compensation voltage generator configured to apply a second voltage to the plurality of pixels, wherein each of the first voltages is a sum of a data voltage and a pixel deviation compensation voltage for compensating for a threshold voltage deviation between the pixels, and wherein the second voltage is a panel deviation compensation voltage for compensating for a threshold voltage deviation between display panels manufactured by a same process for the display panel.

The panel deviation compensation voltage may be a same voltage for the plurality of pixels included in the display panel, and the panel deviation compensation voltage for each of the display panels may be based on an average value or a median value of a threshold voltage distribution of the each of the display panels.

The panel deviation compensation voltage generator may include a compensation voltage level storage block configured to store a voltage level of the panel deviation compensation voltage determined when a corresponding one of the display panels is manufactured, and a compensation voltage generation block configured to generate the panel deviation compensation voltage having the voltage level stored in the compensation voltage level storage block.

The display device may further include a sensing circuit configured to sense threshold voltages of the plurality of pixels through a plurality of lines to which the second voltage is applied.

As described above, in the pixel of the display panel and the display device according to one or more embodiments, a threshold voltage deviation between a plurality of pixels in the same display panel is compensated using a first voltage, and a threshold voltage deviation between a plurality of display panels manufactured by the same process is compensated using a second voltage. Accordingly, a voltage range of a data driver may be reduced, and thus a cost and power consumption of the data driver may be reduced.

BRIEF DESCRIPTION OF THE DRAWINGS

Illustrative, non-limiting embodiments will be more clearly understood from the following detailed description taken in conjunction with the accompanying drawings.

FIG. 2 is a diagram illustrating an example of threshold voltage distributions of a plurality of display panels manufactured by the same process.

FIG. 3 is a diagram for describing an example of a voltage range of a convention data driver and an example of a voltage range of a data driver according to embodiments.

DETAILED DESCRIPTION

Figure 1:
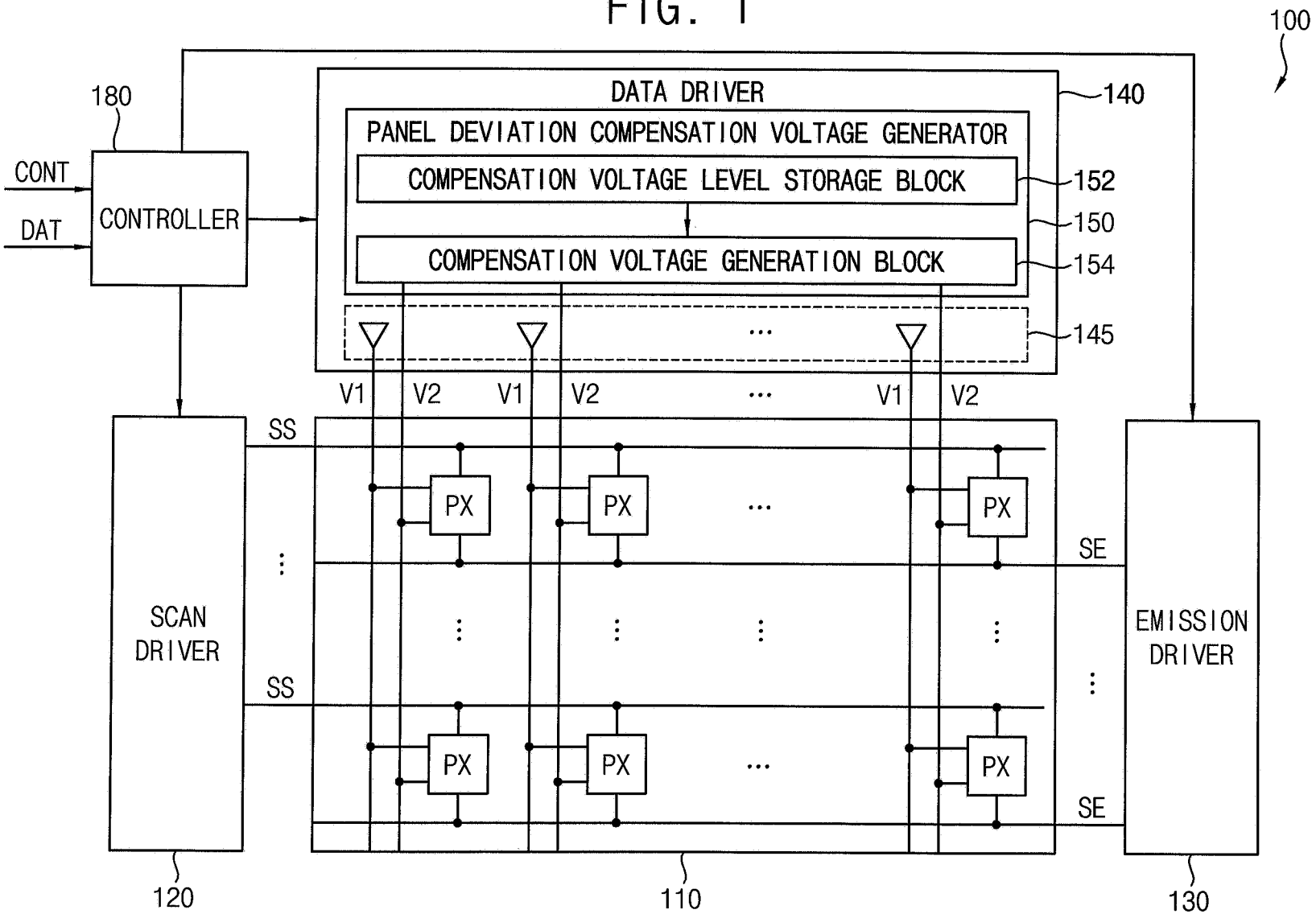
FIG. 1 is a block diagram illustrating a display device according to embodiments.

Features of the inventive concept and methods of accomplishing the same may be understood more readily by reference to the detailed description of embodiments and the accompanying drawings. Hereinafter, embodiments will be described in more detail with reference to the accompanying drawings. The described embodiments, however, may be embodied in various different forms, and should not be construed as being limited to only the illustrated embodiments herein. Rather, these embodiments are provided as examples so that this disclosure will be thorough and complete, and will fully convey the aspects and features of the present inventive concept to those skilled in the art. Accordingly, processes, elements, and techniques that are not necessary to those having ordinary skill in the art for a complete understanding of the aspects and features of the present inventive concept may not be described. Unless otherwise noted, like reference numerals denote like elements throughout the attached drawings and the written description, and thus, descriptions thereof will not be repeated. Further, parts not related to the description of the embodiments might not be shown to make the description clear. In the drawings, the relative sizes of elements, layers, and regions may be exaggerated for clarity.

Various embodiments are described herein with reference to sectional illustrations that are schematic illustrations of embodiments and/or intermediate structures. As such, variations from the shapes of the illustrations as a result, for example, of manufacturing techniques and/or tolerances, are to be expected. Further, specific structural or functional descriptions disclosed herein are merely illustrative for the purpose of describing embodiments according to the concept of the present disclosure. Thus, embodiments disclosed herein should not be construed as limited to the particular illustrated shapes of regions, but are to include deviations in shapes that result from, for instance, manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the drawings are schematic in nature and their shapes are not intended to illustrate the actual shape of a region of a device and are not intended to be limiting. Additionally, as those skilled in the art would realize, the described embodiments may be modified in various different ways, all without departing from the spirit or scope of the present disclosure.

In the detailed description, for the purposes of explanation, numerous specific details are set forth to provide a thorough understanding of various embodiments. It is apparent, however, that various embodiments may be practiced without these specific details or with one or more equivalent arrangements. In other instances, well-known structures and devices are shown in block diagram form in order to avoid unnecessarily obscuring various embodiments.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. Similarly, when a first part is described as being arranged "on" a second part, this indicates that the first part is arranged at an upper side or a lower side of the second part without the limitation to the upper side thereof on the basis of the gravity direction.

It will be understood that when an element, layer, region, or component is referred to as being "on," "connected to," or "coupled to" another element, layer, region, or component, it can be directly on, connected to, or coupled to the other element, layer, region, or component, or one or more intervening elements, layers, regions, or components may be present. However, "directly connected/directly coupled" refers to one component directly connecting or coupling another component without an intermediate component. Meanwhile, other expressions describing relationships between components such as "between," "immediately between" or "adjacent to" and "directly adjacent to" may be construed similarly. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises," "comprising," "have," "having," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, the term "substantially," "about," "approximately," and similar terms are used as terms of approximation and not as terms of degree, and are intended to account for the inherent deviations in measured or calculated values that would be recognized by those of ordinary skill in the art. "About" or "approximately," as used herein, is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value. Further, the use of "may" when describing embodiments of the present disclosure refers to "one or more embodiments of the present disclosure."

When a certain embodiment may be implemented differently, a specific process order may be performed differently from the described order. For example, two consecutively described processes may be performed substantially at the same time or performed in an order opposite to the described order.

The electronic or electric devices and/or any other relevant devices or components according to embodiments of the present disclosure described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the embodiments of the present disclosure.

Unless otherwise defined, all terms (including technical and scientific terms) used herein have the same meaning as commonly understood by one of ordinary skill in the art to which the present inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram illustrating a display device according to embodiments, FIG. 2 is a diagram illustrating an example of threshold voltage distributions of a plurality of display panels manufactured by the same process, and FIG. 3 is a diagram for describing an example of a voltage range of a convention data driver and an example of a voltage range of a data driver according to embodiments.

Referring to FIG. 1, a display device 100 may include a display panel 110 including a plurality of pixels PX, a scan driver 120 applying scan signals SS to the plurality of pixels PX, an emission driver 130 applying emission control signals SE to the plurality of pixels PX, a data driver 140 applying first voltages V1 to the plurality of pixels PX, and a panel deviation compensation voltage generator 150 applying a second voltage V2 to the plurality of pixels PX. As used herein, the term "deviation" may be used interchangeably with the term "variation." In some embodiments, the display device 100 may further include a controller (e.g., a timing controller) 180 controlling the scan driver 120, the emission driver 130, the data driver 140, and the panel deviation compensation voltage generator 150.

The display panel 110 may include the plurality of pixels PX connected to a plurality of data lines and a plurality of scan lines. In some embodiments, each pixel PX may include an organic light emitting diode (OLED), and the display panel 110 may be an OLED display panel. The pixel PX may further include a driving transistor providing a driving current to the OLED.

The scan driver 120 may sequentially provide the scan signals SS to the plurality of pixels PX on a pixel row basis (e.g., a row-by-row basis) based on a control signal received from the controller 180. In some embodiments, the control signal may include, but is not limited to, a start signal and an input clock signal.

The emission driver 130 may provide the emission control signals SE to the plurality of pixels PX based on a control signal received from the controller 180. In some embodiments, the emission control signals SE may be sequentially applied to the pixels PX on a pixel row basis. In other embodiments, the emission control signals SE may be a global signal that is common to all the pixels PX, and may be substantially simultaneously applied to the pixels PX.

The data driver 140 may provide the first voltages V1 to the plurality of pixels PX based on a control signal and image data received from the controller 180. In some embodiments, the control signal may include, but is not limited to, a horizontal start signal and a load signal. In some embodiments, the data driver 140 may include a plurality of output buffers 145 that respectively output the first voltages V1 to the plurality of data lines.

Each of the first voltages V1 may correspond to a sum of a data voltage and a pixel deviation compensation voltage. The data voltage may be determined corresponding to the image data. Further, the pixel deviation compensation voltage may be used to compensate for a threshold voltage deviation between or among the plurality of pixels PX included in the display panel 110, and may be determined corresponding to a respective threshold voltage of the driving transistor of each pixel PX. Accordingly, because the plurality of pixels PX, which respectively include the plurality of driving transistors having different threshold voltages, receive the first voltages V1 where the pixel deviation compensation voltages respectively corresponding to the threshold voltages are added, the plurality of pixels PX may emit light with substantially the same luminance at a same corresponding gray level.

In some embodiments, the display device 100 may perform a sensing operation that senses the threshold voltages of the driving transistors of the plurality of pixels PX to determine the pixel deviation compensation voltages for the plurality of pixels PX. In other embodiments, the pixel deviation compensation voltages for the plurality of pixels PX may be determined by electrical and/or optical test equipment when the display panel 110 is manufactured.

The controller (e.g., the timing controller) 180 may receive image data DAT and a control signal CONT from an external host processor (e.g., a graphic processing unit (GPU) or a graphic card). In some embodiments, the image data DAT may be RGB data including red image data, green image data, and blue image data. Further, in some embodiments, the control signal CONT may include, but is not limited to, a vertical synchronization signal, a horizontal synchronization signal, a master clock signal and a data enable signal. The controller 180 may control operations of the scan driver 120, the emission driver 130, the data driver 140, and the panel deviation compensation voltage generator 150 based on the image data DAT and the control signal CONT.

The panel deviation compensation voltage generator 150 may apply the second voltage V2 to the plurality of pixels PX through at least one line. In some embodiments, as illustrated in FIG. 1, the panel deviation compensation voltage generator 150 may apply the second voltage to the plurality of pixels PX through a plurality of lines extending in parallel with the plurality of data lines.

However, the at least one line for applying the second voltage V2 is not limited to a plurality of lines extending in parallel with the plurality of data lines. For example, the second voltage V2 may be applied to the plurality of pixels PX through a mesh structure where lines are connected to each other. Further, in some embodiments, as illustrated in FIG. 1, the panel deviation compensation voltage generator 150 may be included in the data driver 140, although a location of the panel deviation compensation voltage generator 150 is not limited to the data driver 140.

The second voltage V2 may be a panel deviation compensation voltage for compensating for a threshold voltage deviation between a plurality of display panels manufactured by the same process for the display panel 110. In some embodiments, the second voltage V2, or the panel deviation compensation voltage, may be the same voltage for the plurality of pixels PX included in the display panel 110. Further, in some embodiments, the second voltage V2, or the panel deviation compensation voltage, for each of the plurality of display panels may be determined when each of the plurality of display panels is manufactured, and may be determined based on an average value or a median value of a threshold voltage distribution (e.g., a distribution of the threshold voltages of the plurality of driving transistors of the plurality of pixels PX included in each display panel 110) of the display panel 110. Accordingly, because the second voltages V2, or the panel deviation compensation voltages, that are respectively suitable for the threshold voltage distributions of the plurality of display panels manufactured by the same process are used, the plurality of display panels may emit light with substantially the same luminance at the same gray level.

In some embodiments, when each display panel 110 is manufactured, the second voltage V2, or the panel deviation compensation voltage, of the display panel 110 may be determined based on the average value or the median value of the threshold voltage distribution of the display panel 110 obtained by a sensing operation of the display device 100. In other embodiments, when each display panel 110 is manufactured, the second voltage V2, or the panel deviation compensation voltage, of the display panel 110 may be determined by electrical or optical test equipment based on the average value or the median value of the threshold voltage distribution of the display panel 110.

For example, as illustrated in FIG. 2, the plurality of driving transistors of the plurality of pixels PX of each display panel 110 may have different threshold voltages. That is, each display panel 110 may have a threshold voltage distribution PL1_VTHD, PL2_VTHD, . . . , PLN_VTHD having an arbitrary width PX_DEV, and the driving transistors of the plurality of pixels PX in the same display panel 110 may have a threshold voltage deviation PX_DEV. This threshold voltage deviation PX_DEV within the same display panel 110 may be referred to as a pixel-to-pixel threshold voltage deviation. In addition, even if a plurality of display panels are manufactured by the same process, the threshold voltage deviation may have different threshold voltage distributions PL1_VTHD, PL2_VTHD, . . . , PLN_VTHD. That is, the plurality of display panels manufactured by the same process also may have a threshold voltage deviation PL_DEV (e.g., a lot-to-lot, or glass-to-glass, threshold voltage deviation). This threshold voltage deviation PL_DEV between the different display panels 110 may be referred to as a panel-to-panel threshold voltage deviation.

A data driver of a related art display device using an external compensation method may provide, through a data line, not only a data voltage, but also both of a voltage for compensating for the pixel-to-pixel threshold voltage deviation PX_DEV and a voltage for compensating for the panel-to-panel threshold voltage deviation PL_DEV. Accordingly, as illustrated in FIG. 3, a data range 210 of the data driver of the conventional display device may be sufficiently large to cover an actual data voltage range (e.g., from a 0-gray voltage to a 255-gray voltage), the pixel-to-pixel threshold voltage deviation PX_DEV, and the panel-to-panel threshold voltage deviation PL_DEV, and thus the data driver of the related art display device may use high voltage elements.

However, in the display device 100 according to embodiments of the present disclosure, the pixel-to-pixel threshold voltage deviation PX_DEV within the same display panel 110 may be compensated by the first voltages V1 output from the output buffers 145 of the data driver 140, and the panel-to-panel threshold voltage deviation PL_DEV between the plurality of display panels manufactured by the same process may be compensated by the second voltage V2 generated by the panel deviation compensation voltage generator 150.

Accordingly, as illustrated in FIG. 3, a voltage range 230 of the data driver 140 of the display device 100 according to embodiments of the present disclosure may correspond to a sum of the actual data voltage range and the pixel-to-pixel threshold voltage deviation PX_DEV. Further, components of the data driver 140, such as a level shifter, a digital-to-analog converter, the output buffers 145, etc. may be implemented with low voltage elements. Therefore, a cost and power consumption of the data driver 140 of the display device 100 according to embodiments may be reduced.

In some embodiments, to generate the second voltage V2, or the panel deviation compensation voltage, for compensating for the panel-to-panel threshold voltage deviation, the panel deviation compensation voltage generator 150 may include a compensation voltage level storage block 152 that stores a voltage level of the panel deviation compensation voltage, and a compensation voltage generation block 154 that generates the second voltage V2, or the panel deviation compensation voltage, having the voltage level stored in the compensation voltage level storage block 152. In some embodiments, the voltage level of the panel deviation compensation voltage may be written to the compensation voltage level storage block 152 when the display panel 110 is manufactured, and the compensation voltage level storage block 152 may be implemented with a nonvolatile memory, such as a one-time programmable (OTP) memory.

As described above, in the display device 100 according to embodiments, the pixel-to-pixel threshold voltage deviation PX_DEV within the same display panel 110 may be compensated by the first voltages V1 output from the output buffers 145, and the panel-to-panel threshold voltage deviation PL_DEV between the plurality of display panels may be compensated by the second voltage V2 generated by the panel deviation compensation voltage generator 150. Accordingly, the voltage range 230 of the data driver 140 may be reduced, and thus the cost and the power consumption of the data driver 140 may be reduced.

Figure 4:
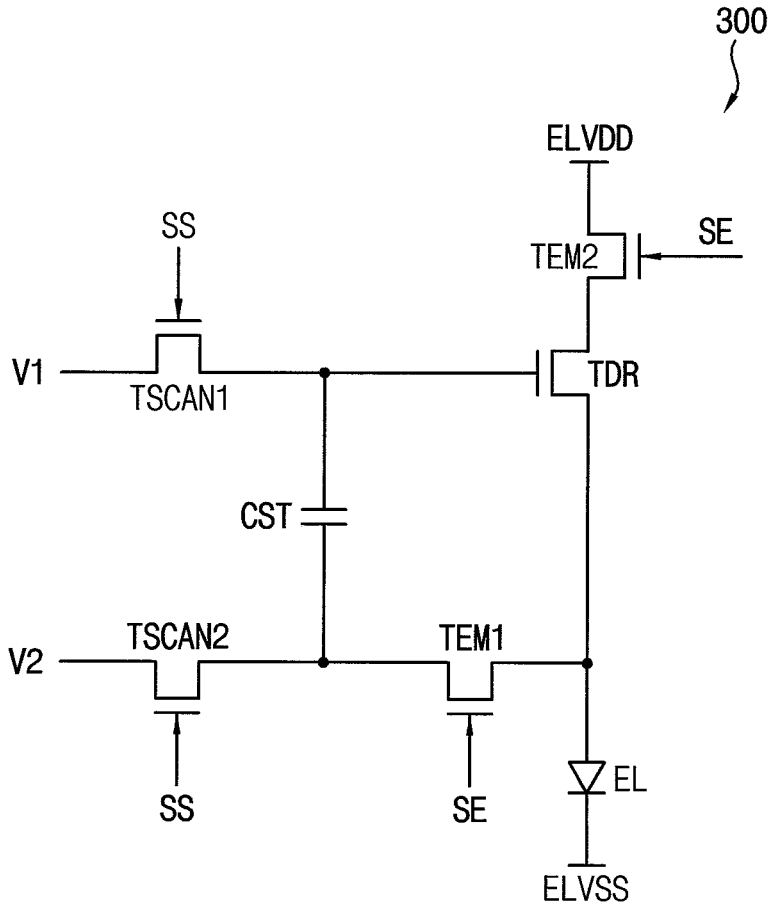
FIG. 4 is a circuit diagram illustrating a pixel according to embodiments.

FIG. 4 is a circuit diagram illustrating a pixel according to embodiments.

Referring to FIG. 4, a pixel 300 according to embodiments may include a storage capacitor CST, first and second scan transistors TSCAN1 and TSCAN2 that respectively transfer a first voltage V1 and a second voltage V2 to respective ends of the storage capacitor CST in response to a scan signal SS, a driving transistor TDR that generates a driving current based on a difference between the first voltage V1 and the second voltage V2 stored in the storage capacitor CST, first and second emission transistors TEM1 and TEM2 that selectively provide the driving current to an organic light emitting diode EL in response to an emission control signal SE, and the organic light emitting diode EL that emits light based on the driving current.

The storage capacitor CST may include a first end (or a first electrode) connected to a gate of the driving transistor TDR, and a second end (or a second electrode) connected to a node between the second scan transistor TSCAN2 and the first emission transistor TEM1.

The first scan transistor TSCAN1 may transfer the first voltage V1 to the first end of the storage capacitor CST connected to the gate of the driving transistor TDR in response to the scan signal SS. In some embodiments, the first scan transistor TSCAN1 may include a gate receiving the scan signal SS, a drain receiving the first voltage V1, and a source connected to the first end of the storage capacitor CST.

The second scan transistor TSCAN2 may transfer the second voltage V2 to the second end of the storage capacitor CST in response to the scan signal SS. In some embodiments, the second scan transistor TSCAN2 may include a gate receiving the scan signal SS, a drain receiving the second voltage V2, and a source connected to the second end of the storage capacitor CST.

The driving transistor TDR may generate the driving current based on a difference of the first voltage V1 and the second voltage V2 stored in the storage capacitor CST. In some embodiments, the driving transistor TDR may include the gate connected to the first end of the storage capacitor CST, a drain connected to a source of the second emission transistor TEM2, and a source connected to both the second end of the storage capacitor CST through the first emission transistor TEM1 and the organic light emitting diode EL.

The first emission transistor TEM1 may connect the second end of the storage capacitor CST to the source of the driving transistor TDR in response to the emission control signal SE. In some embodiments, the first emission transistor TEM1 may include a gate receiving the emission control signal SE, a drain connected to the second end of the storage capacitor CST, and a source connected to the source of the driving transistor TDR.

The second emission transistor TEM2 may connect a line of a first power supply voltage ELVDD to the drain of the driving transistor TDR in response to the emission control signal SE. In some embodiments, the second emission transistor TEM2 may include a gate receiving the emission control signal SE, a drain connected to the line of the first power supply voltage ELVDD, and a source connected to the drain of the driving transistor TDR.

The organic light emitting diode EL may emit light based on the driving current generated by the driving transistor TDR while the first and second emission transistors TEM1 and TEM2 are turned on. In some embodiments, the organic light emitting diode EL may include an anode connected to the source of the driving transistor TDR, and a cathode connected to a line of a second power supply voltage ELVSS.

The first voltage V1 applied to the first end of the storage capacitor CST may be a sum of a data voltage and a pixel deviation compensation voltage for compensating for a threshold voltage deviation between a plurality of pixels 300 included in a display panel. The second voltage V2 applied to the second end of the storage capacitor CST may be a panel deviation compensation voltage for compensating for a threshold voltage deviation between a plurality of display panels manufactured by the same process.

Accordingly, the plurality of pixels 300 within the same display panel may emit light with substantially the same luminance at the same gray level by using the first voltage V1 including the pixel deviation compensation voltage. Also, the plurality of display panels manufactured by the same process may emit light with substantially the same luminance at the same gray level by using the second voltage V2 that is the panel deviation compensation voltage. Further, because the threshold voltage deviation between the plurality of display panels is compensated not by the first voltage V1 output from a data driver, but by the second voltage V2 generated by a panel deviation compensation voltage generator, a voltage range of the data driver may be reduced, and thus a cost and power consumption of the data driver may be reduced.

In some embodiments, all of the transistors TSCAN1, TSCAN2, TEM1, TEM2 and TDR may be NMOS low temperature poly-silicon (LTPS) thin-film transistors (TFTs). In other embodiments, all of the transistors TSCAN1, TSCAN2, TEM1, TEM2 and TDR may be NMOS oxide TFTs. In still other embodiments, a portion of the transistors TSCAN1, TSCAN2, TEM1, TEM2 and TDR may be NMOS LTPS TFTs while the remaining ones of the transistors TSCAN1, TSCAN2, TEM1, TEM2 and TDR may be NMOS oxide TFTs. In one example, the first scan transistor TSCAN1 may be an NMOS oxide TFT, and the second scan transistor TSCAN2, the first emission transistor TEM1, the second emission transistor TEM2, and the driving transistor TDR may be NMOS LTPS TFTs. In another example, the first scan transistor TSCAN1 and the second scan transistor TSCAN2 may be NMOS oxide TFTs, and the first emission transistor TEM1, the second emission transistor TEM2, and the driving transistor TDR may be NMOS LTPS TFTs. In still another example, the first scan transistor TSCAN1, the second scan transistor TSCAN2, and the first emission transistor TEM1 may be NMOS oxide TFTs, and the second emission transistor TEM2 and the driving transistor TDR may be NMOS LTPS TFTs. In still another example, the first scan transistor TSCAN1, the second scan transistor TSCAN2, the first emission transistor TEM1, and the second emission transistor TEM2 may be NMOS oxide TFTs, and the driving transistor TDR may be an NMOS LTPS TFT.

Hereinafter, an operation of the pixel 300 according to embodiments will be described below with reference to FIG. 4 through FIG. 6B.

Figure 5:
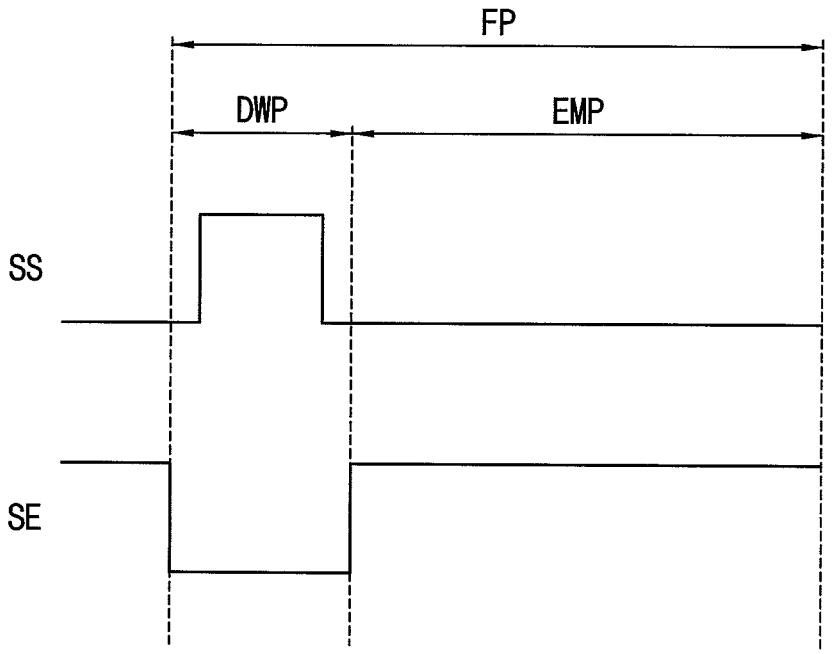
FIG. 5 is a timing diagram for describing an operation of a pixel according to embodiments.
Figure 6A:
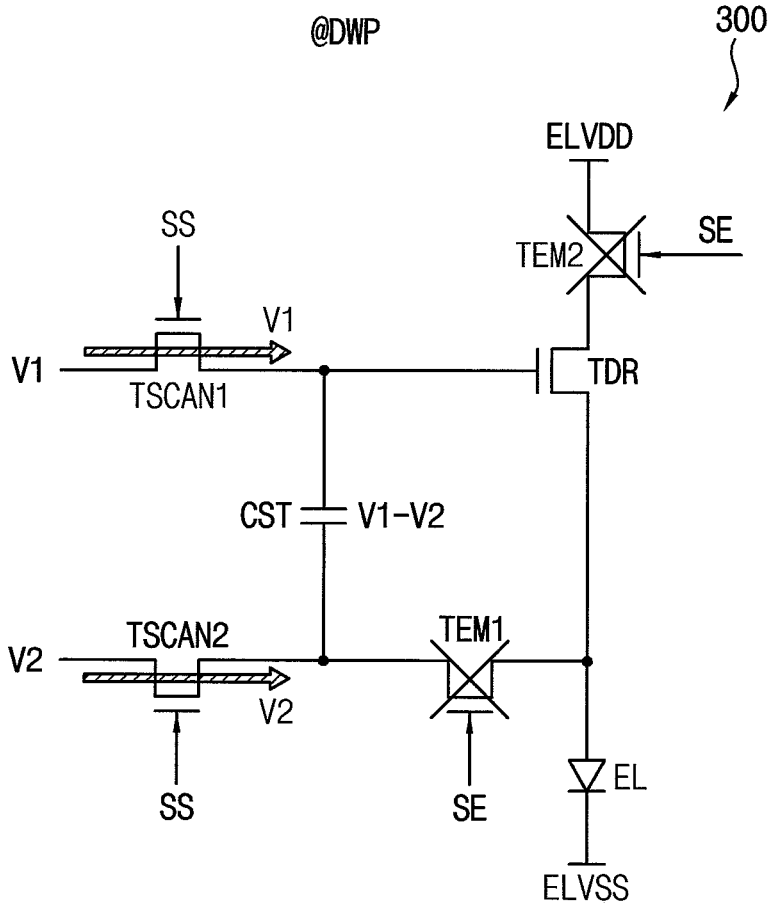
FIG. 6A is a circuit diagram for describing an operation of a pixel in a data writing period according to embodiments.
Figure 6B:
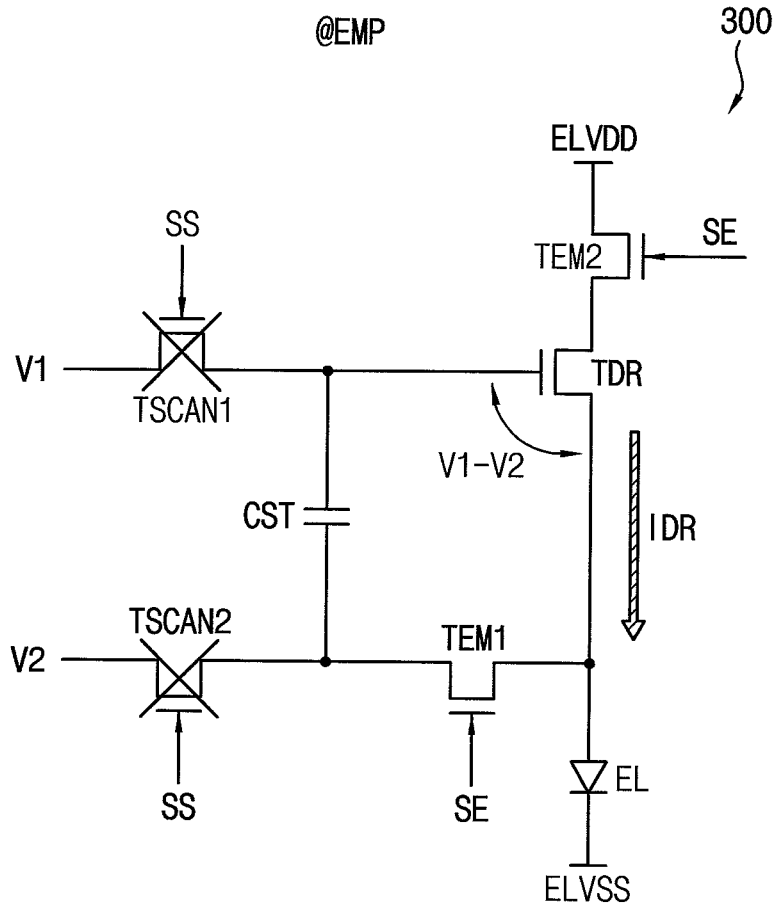
FIG. 6B is a circuit diagram for describing an operation of a pixel in an emission period according to embodiments

FIG. 5 is a timing diagram for describing an operation of a pixel according to embodiments, FIG. 6A is a circuit diagram for describing an operation of a pixel in a data writing period according to embodiments, and FIG. 6B is a circuit diagram for describing an operation of a pixel in an emission period according to embodiments Referring to FIG. 4 and FIG. 5, each frame period FP of a display device including a pixel 300 may include a data writing period DWP in which a first voltage V1 and a second voltage V2 are applied to a storage capacitor CST, and an emission period EMP in which an organic light emitting diode EL emits light.

Referring to FIG. 5 and FIG. 6A, in the data writing period DWP, a scan signal SS having a turn-on level (e.g., a high level) may be provided, and an emission control signal SE having a turn-off level (e.g., a low level) may be provided. First and second emission transistors TEM1 and TEM2 may be turned off in response to the emission control signal SE having the turn-off level, and first and second scan transistors TSCAN1 and TSCAN2 may be turned on in response to the scan signal SS having the turn-on level. The turned-on first scan transistor TSCAN1 may transfer the first voltage V1 to a first end of a storage capacitor CST, and the turned-on second scan transistor TSCAN2 may transfer the second voltage V2 to a second end of the storage capacitor CST. Accordingly, the storage capacitor CST may store a difference V1-V2 between the first voltage V1 and the second voltage V2.

Referring to FIG. 5 and FIG. 6B, in the emission period EMP, the scan signal SS having the turn-off level (e.g., the low level) may be provided, and the emission control signal SE having the turn-on level (e.g., the high level) may be provided. The first and second scan transistors TSCAN1 and TSCAN2 may be turned off in response to the scan signal SS having the turn-off level, and the first and second emission transistors TEM1 and TEM2 may be turned on in response to the emission control signal SE having the turn-on level. The turned-on first emission transistor TEM1 may connect the second end of the storage capacitor CST to a source of a driving transistor TDR. Accordingly, a gate of driving transistor TDR may be connected to the first end of the storage capacitor CST, the source of the driving transistor TDR may be connected to the second end of the storage capacitor CST, and thus the difference V1−V2 between the first voltage V1 and the second voltage V2 stored in the storage capacitor CST may be provided as a gate-source voltage to the driving transistor TDR.

The driving transistor TDR may generate a driving current IDR corresponding to the difference V1−V2 between the first voltage V1 and the second voltage V2. Further, the turned-on second emission transistor TEM2 may form a current path from a line of a first power supply voltage ELVDD to a line of a second power supply voltage ELVSS. Accordingly, the driving current IDR generated by the driving transistor TDR may be provided to the organic light emitting diode EL, and the organic light emitting diode EL may emit light based on the driving current IDR. Because the driving transistor TDR is generated based on the first voltage V1 including a pixel deviation compensation voltage and the second voltage that is a panel deviation compensation voltage, the organic light emitting diode EL may emit light with luminance where a pixel-to-pixel threshold voltage deviation and a panel-to-panel threshold voltage deviation are compensated.

Figure 7:
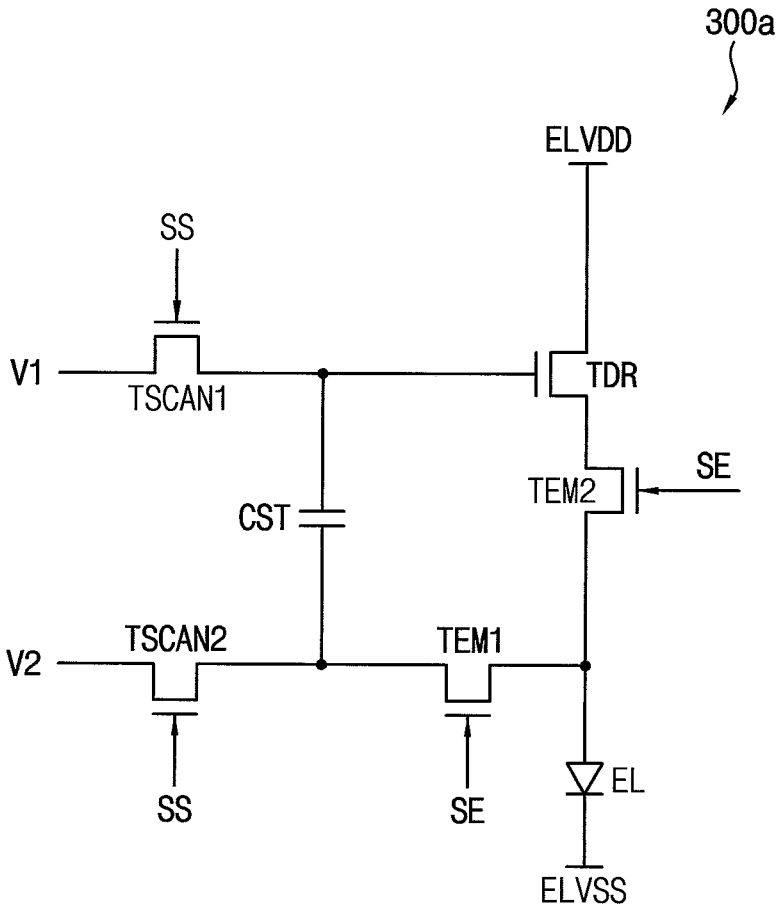
FIG. 7 is a circuit diagram illustrating a pixel according to embodiments.

FIG. 7 is a circuit diagram illustrating a pixel according to embodiments.

Referring to FIG. 7, a pixel 300*a* may include a storage capacitor CST, at least one scan transistor TSCAN1 and TSCAN2, a driving transistor TDR, at least one emission transistor TEM1 and TEM2, and an organic light emitting diode EL. The pixel 300*a* of FIG. 7 may have a similar configuration and a similar operation to a pixel 300 of FIG. 4, with the exception of a location of a second emission transistor TEM2.

In the pixel 300*a* of FIG. 7, a first emission transistor TEM1 may connect a second end of the storage capacitor CST to a source of the second emission transistor TEM2 in response to a emission control signal SE, and the second emission transistor TEM2 may connect a source of the driving transistor TDR to the source of the first emission transistor TEM1 and the organic light emitting diode EL in response to the emission control signal SE. In some embodiments, the first emission transistor TEM1 may include a gate receiving the emission control signal SE, a drain connected to the second end of the storage capacitor CST, and the source connected to the source of the second emission transistor TEM2, and the second emission transistor TEM2 may include a gate receiving the emission control signal SE, a drain connected to the source of the driving transistor TDR, and the source connected to the source of the first emission transistor TEM1 and the organic light emitting diode EL.

Figure 8:
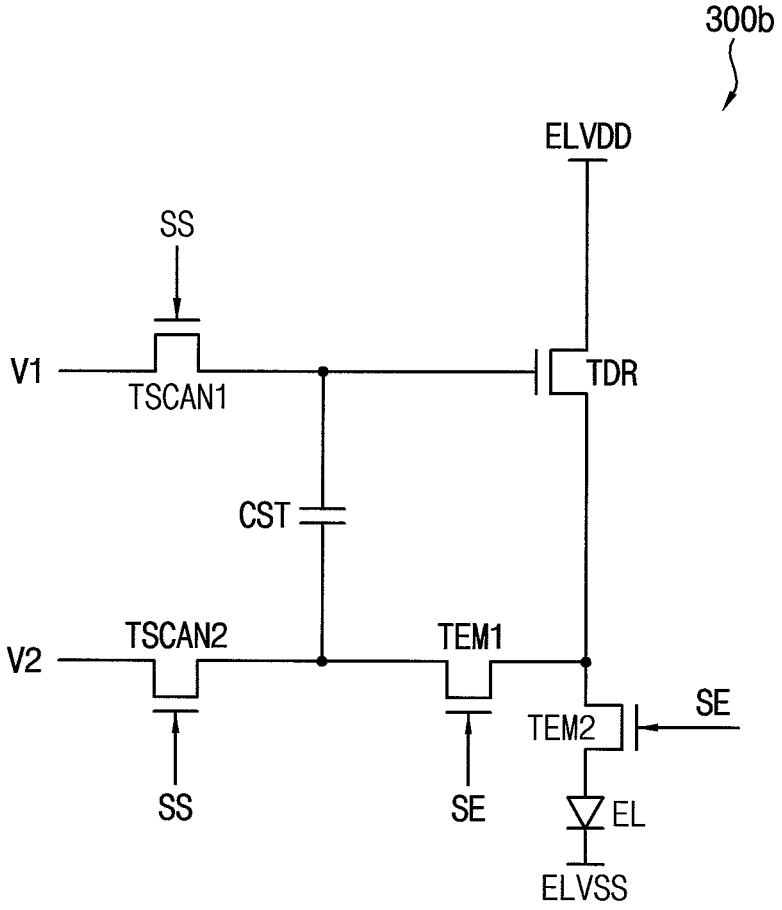
FIG. 8 is a circuit diagram illustrating a pixel according to embodiments.

FIG. 8 is a circuit diagram illustrating a pixel according to embodiments.

Referring to FIG. 8, a pixel 300*b* may include a storage capacitor CST, at least one scan transistor TSCAN1 and TSCAN2, a driving transistor TDR, at least one emission transistor TEM1 and TEM2, and an organic light emitting diode EL. The pixel 300*b* of FIG. 8 may have a similar configuration and a similar operation to a pixel 300 of FIG. 4 with the exception of a location of a second emission transistor TEM2.

In the pixel 300*b* of FIG. 8, a first emission transistor TEM1 may connect a second end of a storage capacitor CST to a source of the driving transistor TDR in response to an emission control signal SE, and a second emission transistor TEM2 may connect the source of the driving transistor TDR to the organic light emitting diode EL in response to the emission control signal SE. In some embodiments, the first emission transistor TEM1 may include a gate receiving the emission control signal SE, a drain connected to the second end of the storage capacitor CST, and a source connected to the source of the driving transistor TDR, and the second emission transistor TEM2 may include a gate receiving the emission control signal SE, a drain connected to the source of the driving transistor TDR, and the source connected to the organic light emitting diode EL.

Figure 9:
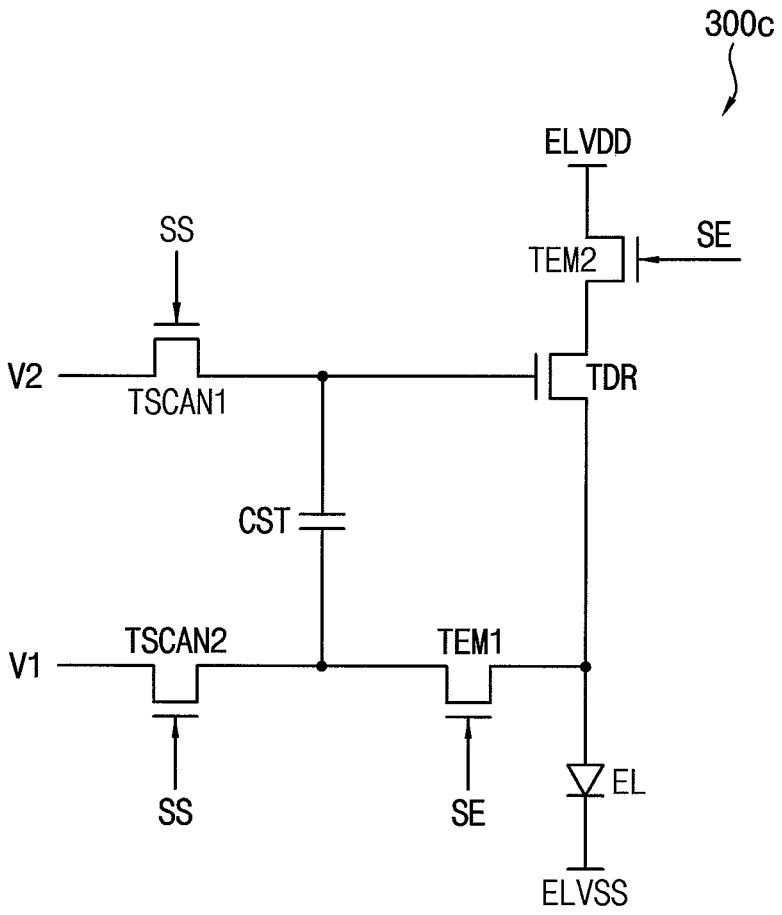
FIG. 9 is a circuit diagram illustrating a pixel according to embodiments.

FIG. 9 is a circuit diagram illustrating a pixel according to embodiments.

Referring to FIG. 9, a pixel 300*c* may include a storage capacitor CST, at least one scan transistor TSCAN1 and TSCAN2, a driving transistor TDR, at least one emission transistor TEM1 and TEM2, and an organic light emitting diode EL. The pixel 300*c* of FIG. 9 may have a similar configuration and a similar operation to a pixel 300 of FIG. 4, except that a second voltage V2 output from a panel deviation compensation voltage generator may be provided to a first scan transistor TSCAN1, and a first voltage V1 output from an output buffer of a data driver may be provided to a second scan transistor TSCAN2.

In the pixel 300*c* of FIG. 9, the first scan transistor TSCAN1 may transfer the second voltage V2 to a first end of the storage capacitor CST connected to a gate of the driving transistor TDR in response to a scan signal SS, and the second scan transistor TSCAN2 may transfer the first voltage V1 to a second end of the storage capacitor CST in response to the scan signal SS. In some embodiments, the first scan transistor TSCAN1 may include a gate receiving the scan signal SS, a drain receiving the second voltage V2, and a source connected to the first end of the storage capacitor CST, and the second scan transistor TSCAN2 may include a gate receiving the scan signal SS, a drain receiving the first voltage V1, and a source connected to the second end of the storage capacitor CST.

In a display device including a pixel 300 of FIG. 4, a pixel 300*a* of FIG. 7 or a pixel 300*b* of FIG. 8, a data voltage included in the first voltage V1 may be increased as a gray level increases. However, in a display device including the pixel 300*c* of FIG. 9, as the gray level increases, the data voltage included in the first voltage V1 may contrastingly decrease to increase a gate-source voltage of the driving transistor TDR.

Figure 10:
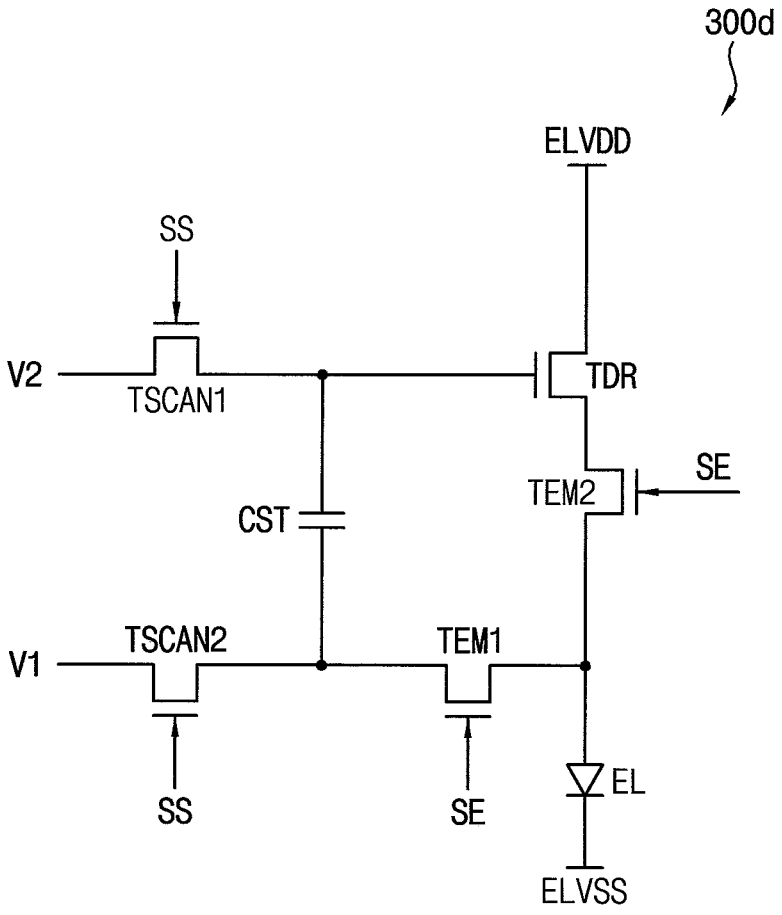
FIG. 10 is a circuit diagram illustrating a pixel according to embodiments.

FIG. 10 is a circuit diagram illustrating a pixel according to embodiments.

Referring to FIG. 10, a pixel 300*d* may include a storage capacitor CST, at least one scan transistor TSCAN1 and TSCAN2, a driving transistor TDR, at least one emission transistor TEM1 and TEM2, and an organic light emitting diode EL. The pixel 300*d* of FIG. 10 may have a similar configuration and a similar operation to a pixel 300*a* of FIG. 7, except that a second voltage V2 output from a panel deviation compensation voltage generator may be provided to a first scan transistor TSCAN1, and a first voltage V1 output from an output buffer of a data driver may be provided to a second scan transistor TSCAN2. In a display device including the pixel 300*d* of FIG. 10, as a gray level increases, a data voltage included in the first voltage V1 may be decreased.

Figure 11:
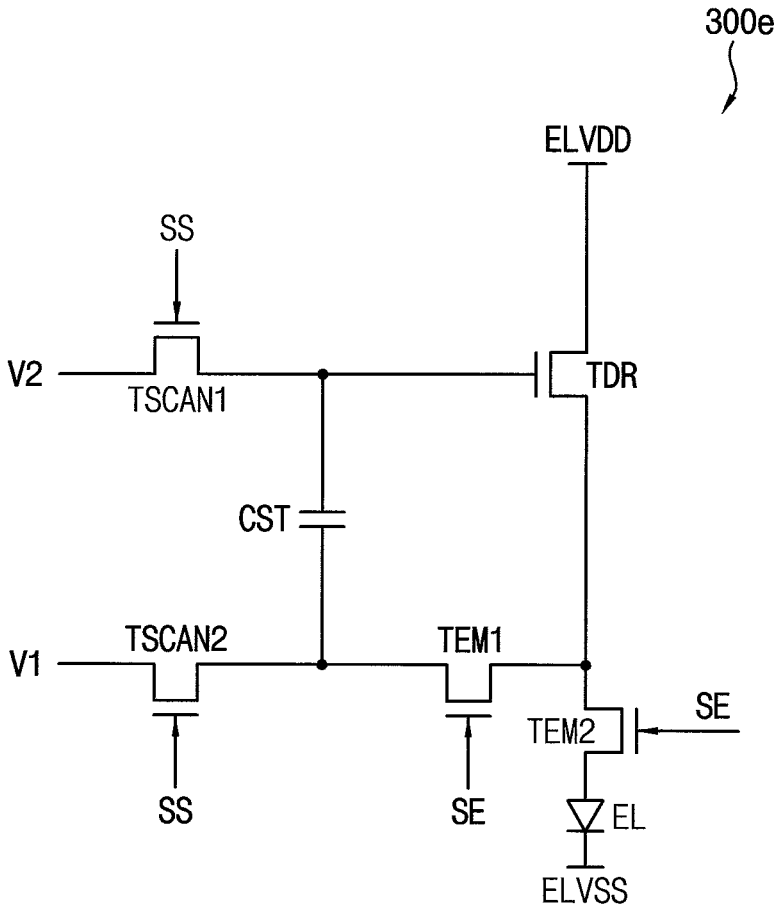
FIG. 11 is a circuit diagram illustrating a pixel according to embodiments.

FIG. 11 is a circuit diagram illustrating a pixel according to embodiments.

Referring to FIG. 11, a pixel 300*e* may include a storage capacitor CST, at least one scan transistor TSCAN1 and TSCAN2, a driving transistor TDR, at least one emission transistor TEM1 and TEM2, and an organic light emitting diode EL. The pixel 300*e* of FIG. 11 may have a similar configuration and a similar operation to a pixel 300*b* of FIG. 8, except that a second voltage V2 output from a panel deviation compensation voltage generator may be provided to a first scan transistor TSCAN1, and a first voltage V1 output from an output buffer of a data driver may be provided to a second scan transistor TSCAN2. In a display device including the pixel 300*e* of FIG. 11, as a gray level increases, a data voltage included in the first voltage V1 may be decreased.

Figure 12:
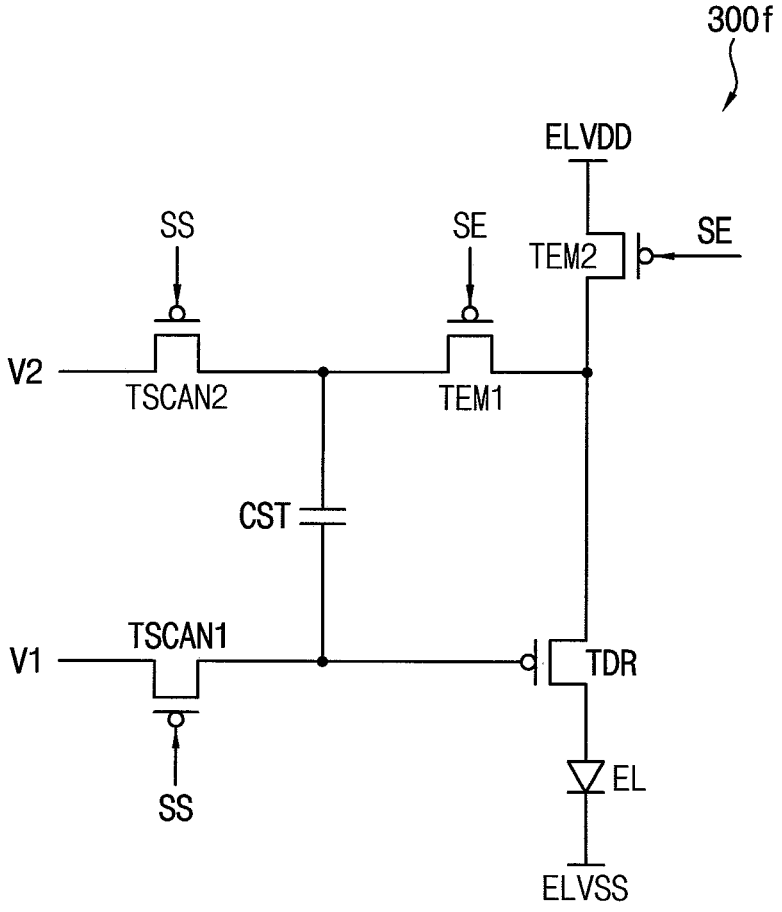
FIG. 12 is a circuit diagram illustrating a pixel according to embodiments.

FIG. 12 is a circuit diagram illustrating a pixel according to embodiments.

Referring to FIG. 12, a pixel 300*f* may include a storage capacitor CST, at least one scan transistor TSCAN1 and TSCAN2, a driving transistor TDR, at least one emission transistor TEM1 and TEM2, and an organic light emitting diode EL. Unlike pixels 300, 300*a*, 300*b*, 300*c*, 300*d* and 300*e* of FIG. 4, FIG. 7, FIG. 8, FIG. 9, FIG. 10 and FIG. 11 including NMOS transistors, the transistors TSCAN1, TSCAN2, TEM1, TEM2 and TDR of the pixel 300*f* of FIG. 12 may be implemented with PMOS transistors. However, the pixel 300*f* of FIG. 12 may have a similar configuration and a similar operation to a pixel 300 of FIG. 4, except that the transistors TSCAN1, TSCAN2, TEM1, TEM2 and TDR are implemented with the PMOS transistors.

Similar to the pixel 300*f* of FIG. 12 including the PMOS transistors instead of NMOS transistors of the pixel 300 of FIG. 4, NMOS transistors of pixels 300*a*, 300*b*, 300*c*, 300*d* and 300*e* of FIG. 7, FIG. 8, FIG. 9, FIG. 10 and FIG. 11 may be replaced by PMOS transistors.

FIGS. 13 through 16 are circuit diagrams illustrating examples of hybrid pixels according to embodiments.

A pixel according to embodiments may include only NMOS transistors as illustrated in FIG. 4, may include only PMOS transistors as illustrated in FIG. 12, or may be a hybrid pixel including at least one NMOS transistor (e.g., at least one NMOS oxide transistor) and at least one PMOS transistor (e.g., at least one PMOS LTPS TFT).

Figure 13:
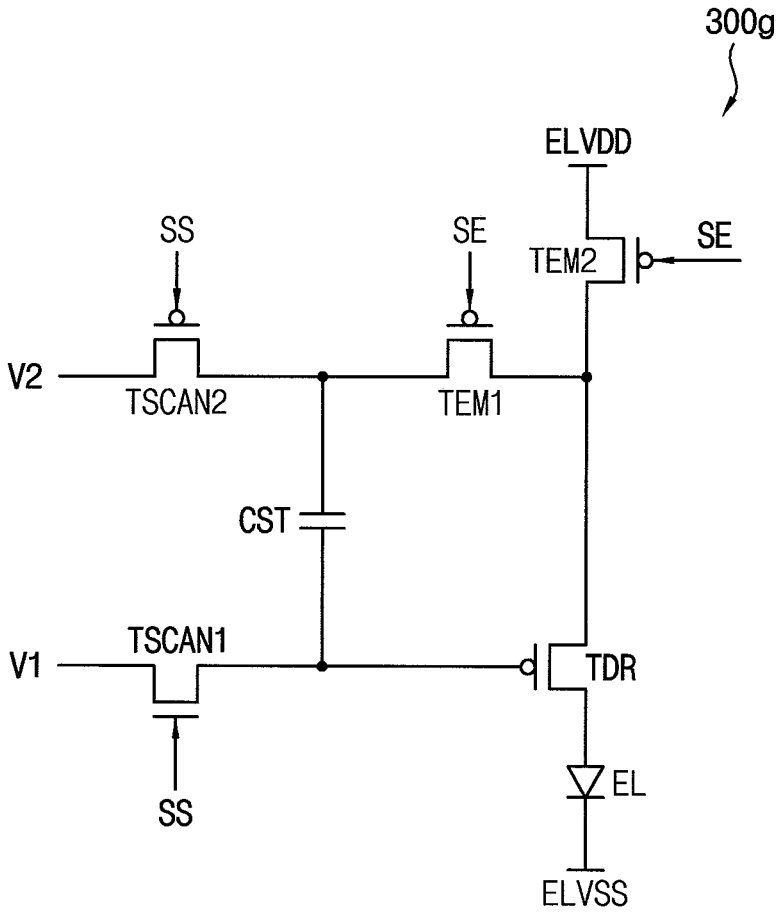
FIGS. 13 through 16 are circuit diagrams illustrating examples of hybrid pixels according to embodiments.

As illustrated in FIG. 13, a pixel 300*g* according to embodiments may include a first scan transistor TSCAN1 that is an NMOS oxide TFT, and may further include a second scan transistor TSCAN2, a first emission transistor TEM1, a second emission transistor TEM2, and a driving transistor TDR that are PMOS LTPS TFTs.

Figure 14:
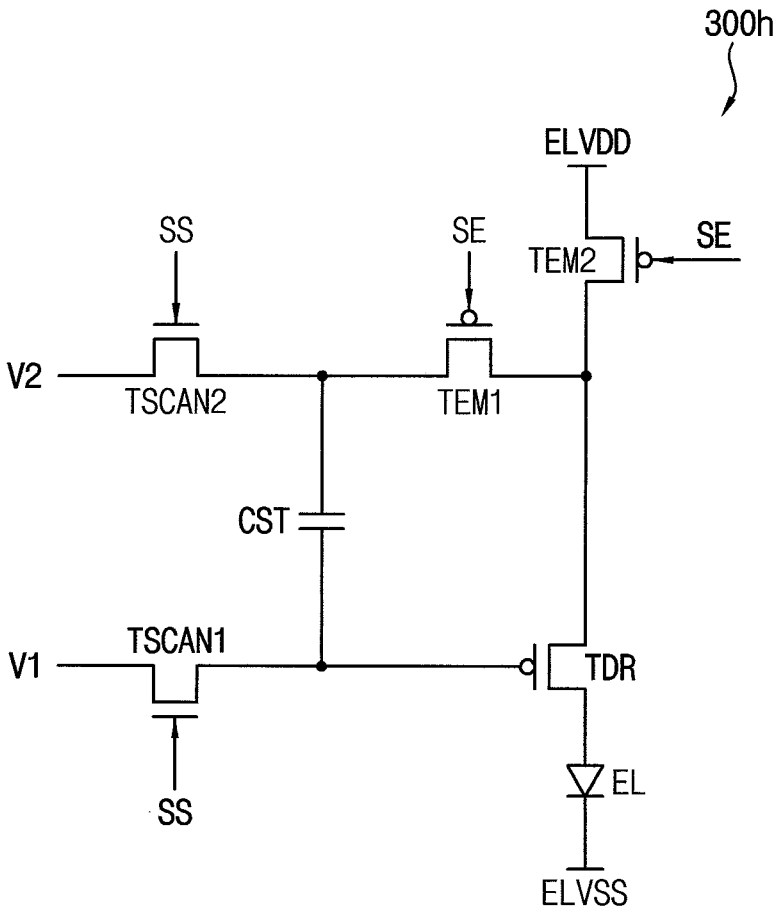

As illustrated in FIG. 14, a pixel 300*h* according to embodiments may include a first scan transistor TSCAN1 and a second scan transistor TSCAN2 that are NMOS oxide TFTs, and may further include a first emission transistor TEM1, a second emission transistor TEM2, and a driving transistor TDR that are PMOS LTPS TFTs.

Figure 15:
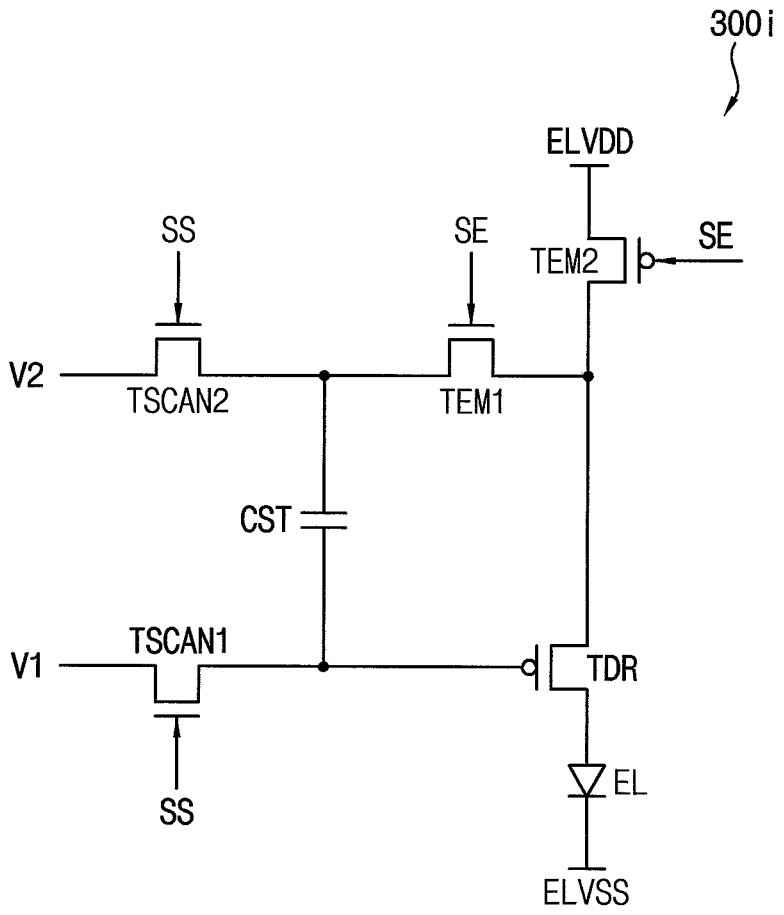

As illustrated in FIG. 15, a pixel 300*i* according to embodiments may include a first scan transistor TSCAN1, a second scan transistor TSCAN2, and a first emission transistor TEM1 that are NMOS oxide TFTs, and may further include a second emission transistor TEM2 and a driving transistor TDR that are PMOS LTPS TFTs.

Figure 16:
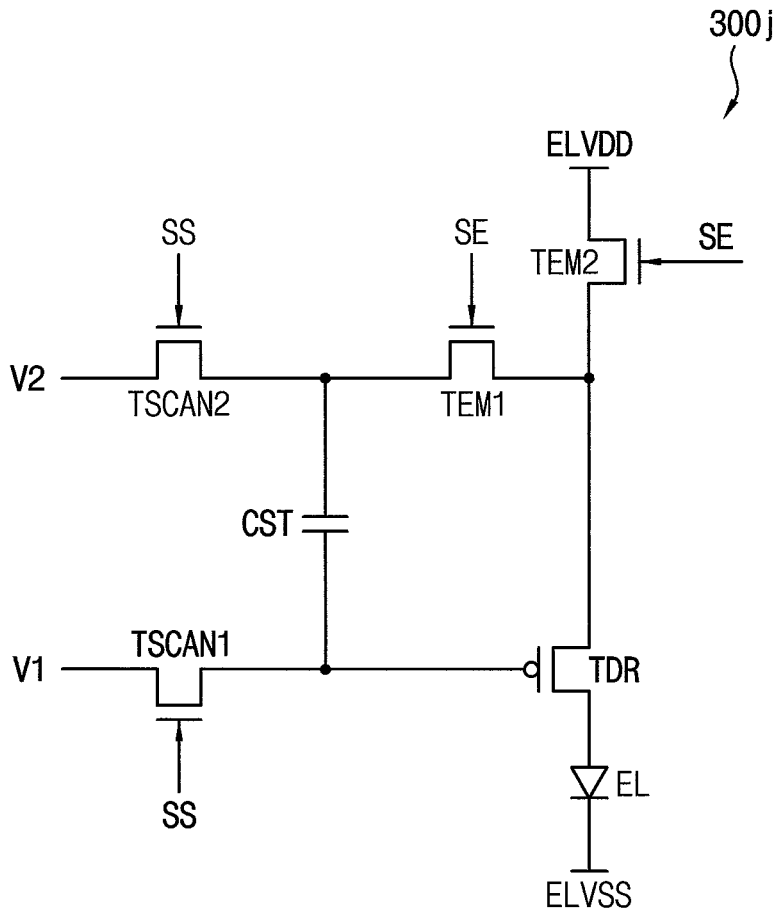

As illustrated in FIG. 16, a pixel 300*j* according to embodiments may include a first scan transistor TSCAN1, a second scan transistor TSCAN2, a first emission transistor TEM1, and a second emission transistor TEM2 that are NMOS oxide TFTs, and may further include a driving transistor TDR that is a PMOS LTPS TFT.

Although FIGS. 13 through 16 illustrate examples of a hybrid pixel including at least one NMOS oxide TFT and at least one PMOS LTPS TFT, a configuration of a pixel according to embodiments may not be limited to the examples of FIGS. 13 through 16.

Figure 17:
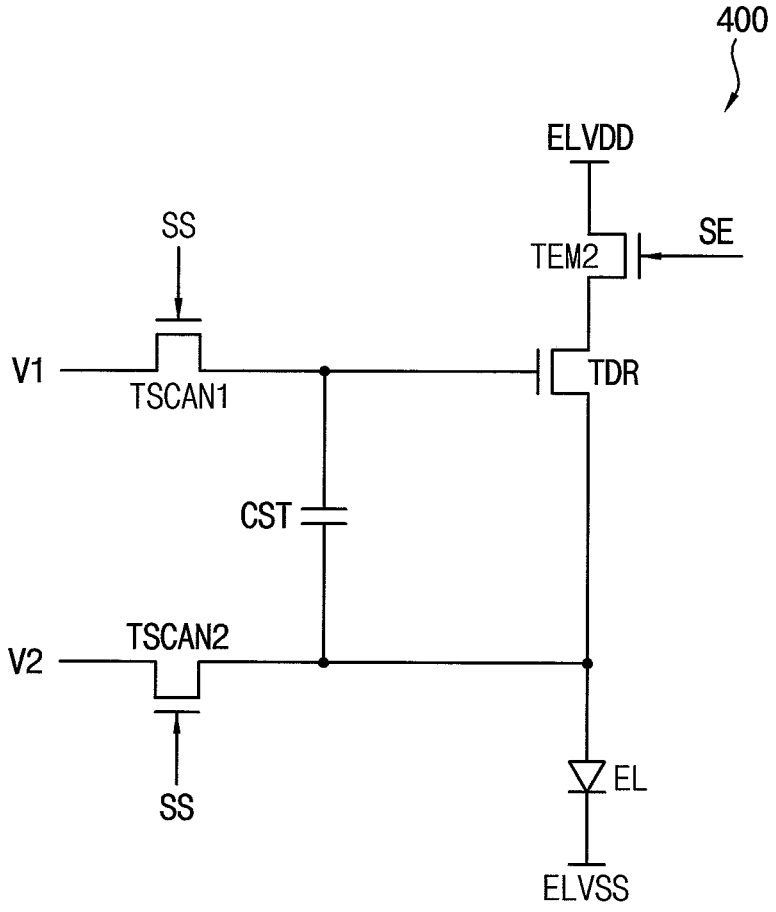
FIG. 17 is a circuit diagram illustrating a pixel having a 4T1C structure according to embodiments.

FIG. 17 is a circuit diagram illustrating a pixel having a 4T1C structure according to embodiments (e.g., 4 transistors and 1 capacitor).

Referring to FIG. 17, a pixel 400 may include a storage capacitor CST, at least one scan transistor TSCAN1 and TSCAN2, a driving transistor TDR, an emission transistor TEM2, and an organic light emitting diode EL. Unlike a pixel 300 of FIG. 4 having a 5T1C structure including two emission transistors TEM1 and TEM2, the pixel 400 of FIG. 17 may have a 4T1C structure including only one emission transistor TEM2. In the pixel 400 of FIG. 17, the storage capacitor CST may be directly connected to an anode of the organic light emitting diode EL. Further, in the pixel 400 of FIG. 17, a second voltage V2 applied to the anode of the organic light emitting diode EL through a second scan transistor TSCAN2 may have a voltage level lower than that of a second power supply voltage ELVSS to which a threshold voltage of the organic light emitting diode EL is added in order for the organic light emitting diode EL to not emit light by the second voltage V2.

Similar to the pixel 400 of FIG. 17 having the 4T1C structure where a first emission transistor TEM1 from the pixel 300 of FIG. 4 is omitted, pixels 300*a* through 300*j* of FIGS. 7 through 16 also may have the 4T1C structure by removing the first emission transistor TEM1.

Figure 18:
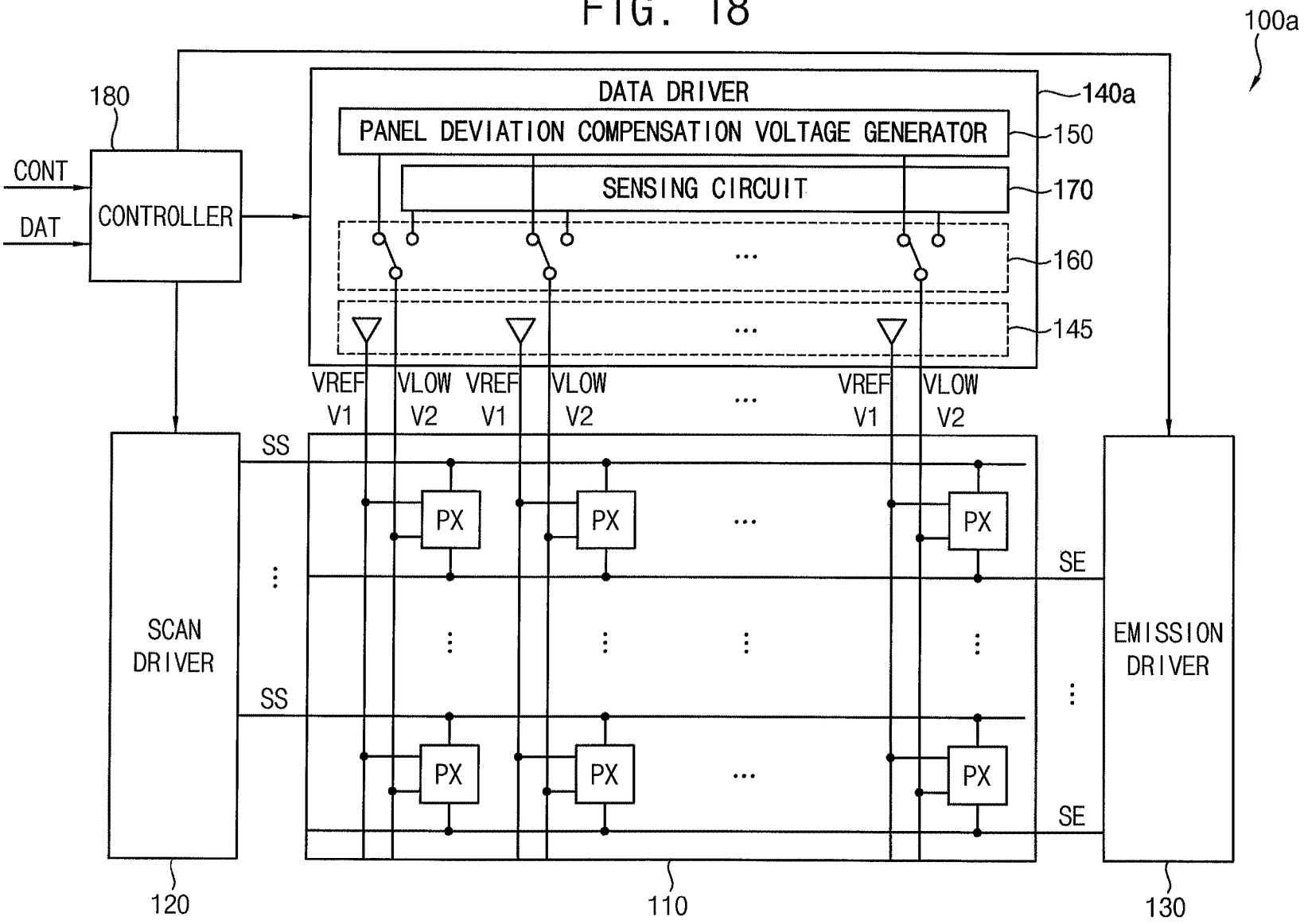
FIG. 18 is a block diagram illustrating a display device according to embodiments.
Figure 19:
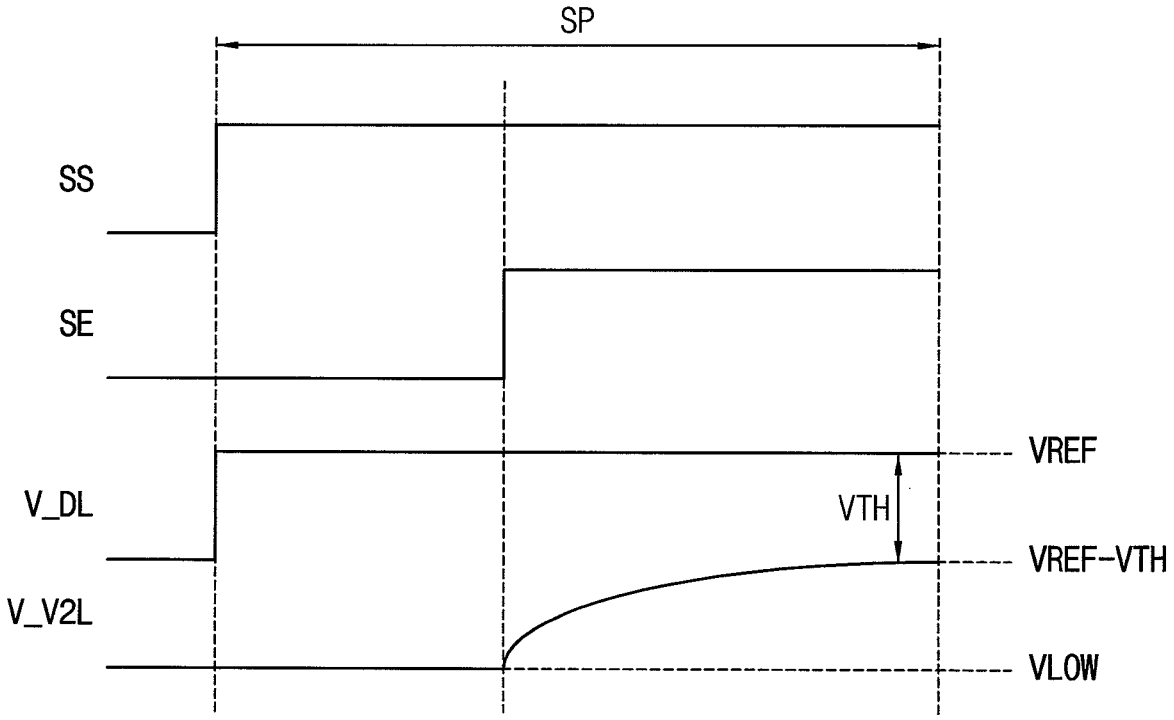
FIG. 19 is a timing diagram for describing an operation of a display device of FIG. 18 in a sensing period according to embodiments.

FIG. 18 is a block diagram illustrating a display device according to embodiments, and FIG. 19 is a timing diagram for describing an operation of a display device of FIG. 18 in a sensing period according to embodiments.

Referring to FIG. 18, a display device 100*a* may include a display panel 110, a scan driver 120, an emission driver 130, a data driver 140*a*, a panel deviation compensation voltage generator 150, a switching unit 160, a sensing circuit 170, and a controller 180. The display device 100*a* of FIG. 18 may have a similar configuration and a similar operation to a display device 100 of FIG. 1, except that the display device 100*a* may further include the switching unit 160 that selectively connects a plurality of lines to which a second voltage V2 is applied to the panel deviation compensation voltage generator 150 or to the sensing circuit 170, and the sensing circuit 170 that senses threshold voltages of a plurality of pixels PX through the plurality of lines to which the second voltage V2 is applied.

Referring to FIG. 18 and FIG. 19, in a sensing period SP, a scan signal SS having a turn-on level (e.g., a high level) may be provided, output buffers 145 of the data driver 140*a* may output a reference voltage VREF as voltages V_DL of data lines, and the panel deviation compensation voltage generator 150 may output a low voltage VLOW as voltages V_V2L of the lines to which the second voltage V2 is applied. In some embodiments, the reference voltage VREF may be determined such that organic light emitting diodes may not emit light, and the low voltage VLOW may be determined to be lower than a threshold voltage (of a driving transistor) subtracted from the reference voltage VREF.

When an emission control signal SE is changed from a turn-off level (e.g., a low level) to the turn-on level (e.g., the high level), the switching unit 160 may disconnect the plurality of lines to which the second voltage V2 is applied from the panel deviation compensation voltage generator 150, and may connect the plurality of lines to which the second voltage V2 is applied to the sensing circuit 170. If an emission transistor of each pixel PX is turned on in response to the emission control signal SE, a voltage of a source of the driving transistor of each pixel PX may be changed to a voltage VREF-VTH where the threshold voltage VTH of the driving transistor is subtracted from the reference voltage VREF, and the voltage V_V2L of the line to which the second voltage V2 is applied may become the voltage of the source of the driving transistor, or the voltage VREF-VTH where the threshold voltage VTH is subtracted from the reference voltage VREF. The sensing circuit 170 may sense the threshold voltage VTH of each pixel PX by measuring the voltage V_V2L of the line to which the second voltage V2 is applied, or the voltage VREF-VTH where the threshold voltage VTH is subtracted from the reference voltage VREF. The threshold voltages VTH of the plurality of pixels PX sensed by the sensing circuit 170 may be used to determine the second voltage V2, or a panel deviation compensation voltage when the display panel 110 is manufactured, or may be used to determine or update a pixel deviation compensation voltage included in a first voltage V1 when the display panel 110 is manufactured or while the display device 100*a* operates.

Figure 20:
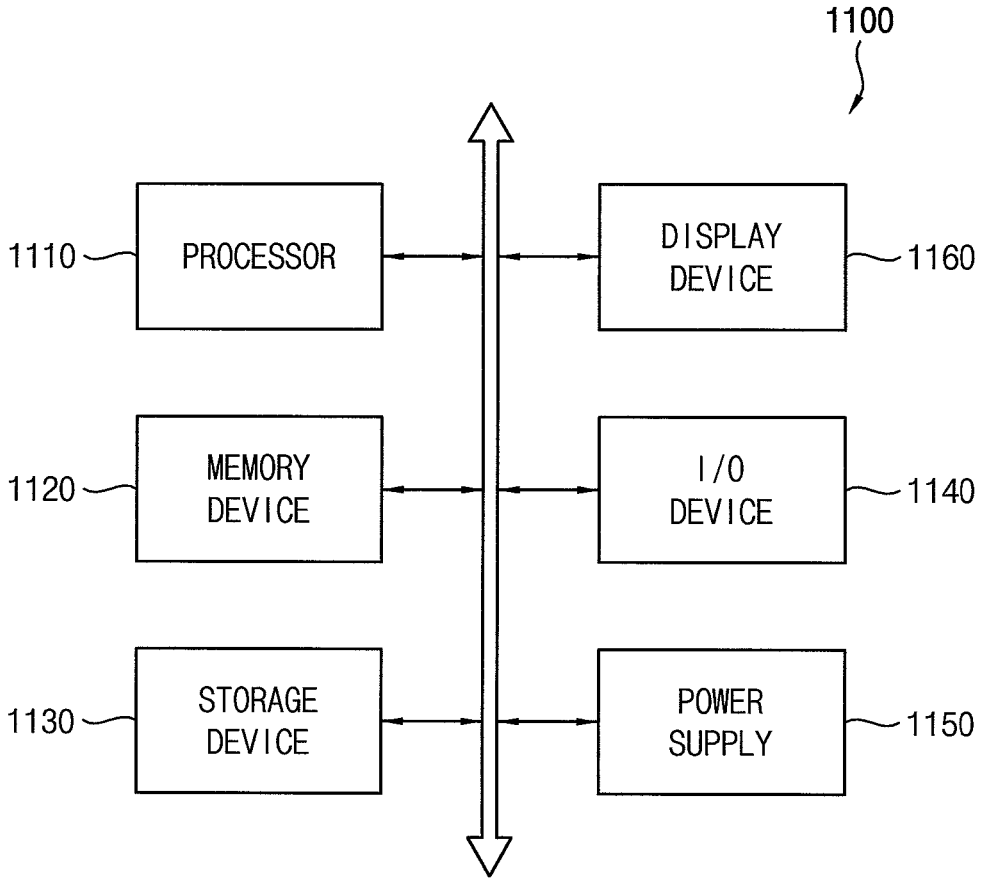
FIG. 20 is a block diagram illustrating an example of an electronic device including a display device according to embodiments.

FIG. 20 is a block diagram illustrating an example of an electronic device including a display device according to embodiments.

Referring to FIG. 20, an electronic device 1100 may include a processor 1110, a memory device 1120, a storage device 1130, an input/output (I/O) device 1140, a power supply 1150, and a display device 1160. The electronic device 1100 may further include a plurality of ports for communicating a video card, a sound card, a memory card, a universal serial bus (USB) device, other electric devices, etc.

The processor 1110 may perform various computing functions. The processor 1110 may be an application processor (AP), a microprocessor, a central processing unit (CPU), etc. The processor 1110 may be coupled to other components via an address bus, a control bus, a data bus, etc. Further, in some embodiments, the processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc., and an output device such as a printer, a speaker, etc. The power supply 1150 may supply power for operations of the electronic device 1100. The display device 1160 may be connected to other components via the buses or other communication links.

The display device 1160 may compensate for a threshold voltage deviation between a plurality of pixels within the same display panel by using first voltages output from output buffers of a data driver, and may compensate for a threshold voltage deviation between a plurality of display panels manufactured by the same process by using a second voltage output from a panel deviation compensation voltage generator. Accordingly, a voltage range of the data driver of the display device 1160 may be reduced, and thus a cost and power consumption of the data driver may be reduced.

According to embodiments, the electronic device 1100 may be any electronic device including the display device 1160, such as a cellular phone, a smart phone, a tablet computer, a wearable device, a personal digital assistant (PDA), a portable multimedia player (PMP), a digital camera, a music player, a portable game console, a navigation system, a digital television, a 3D television, a personal computer (PC), a home appliance, a laptop computer, etc.

The foregoing is illustrative of embodiments and is not to be construed as limiting thereof. Although a few embodiments have been described, those skilled in the art will readily appreciate that many modifications are possible in the embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims with functional equivalents thereof to be include therein.

What is claimed is:

1. A pixel of a display panel, comprising:

a storage capacitor;

at least one scan transistor configured to transfer a first voltage and a second voltage to respective ends of the storage capacitor in response to a scan signal;

a driving transistor configured to generate a driving current based on a difference between the first voltage and the second voltage stored in the storage capacitor;

at least one emission transistor configured to selectively provide the driving current to an organic light emitting diode in response to an emission control signal; and the organic light emitting diode configured to emit light based on the driving current, wherein the first voltage is a sum of a data voltage and a pixel deviation compensation voltage for compensating for a threshold voltage deviation between a plurality of pixels comprised in the display panel, wherein the second voltage is a panel deviation compensation voltage for compensating for a threshold voltage deviation between a plurality of display panels manufactured by a same process for the display panel, and wherein the panel deviation compensation voltage for each of the plurality of display panels is determined based on an average value or a median value of a threshold voltage distribution of the each of the plurality of display panels.

2. The pixel of claim 1, wherein the panel deviation compensation voltage is a same voltage for the plurality of pixels comprised in the display panel.

3. The pixel of claim 1, wherein the panel deviation compensation voltage is determined when the display panel is manufactured.

4. The pixel of claim 1, wherein the at least one scan transistor comprises:

a first scan transistor configured to transfer the second voltage to a first end of the storage capacitor, which is connected to a gate of the driving transistor, in response to the scan signal; and a second scan transistor configured to transfer the first voltage to a second end of the storage capacitor in response to the scan signal.

5. The pixel of claim 4, wherein the first scan transistor comprises a gate for receiving the scan signal, a drain for receiving the second voltage, and a source connected to the first end of the storage capacitor, and wherein the second scan transistor comprises a gate for receiving the scan signal, a drain for receiving the first voltage, and a source connected to the second end of the storage capacitor.

6. The pixel of claim 1, wherein at least one of the at least one scan transistor, the driving transistor, and the at least one emission transistor comprises an NMOS transistor.

7. The pixel of claim 1, wherein at least one of the at least one scan transistor, the driving transistor, and the at least one emission transistor comprises a PMOS transistor.

8. A pixel of a display panel, comprising:

a storage capacitor;

at least one scan transistor configured to transfer a first voltage and a second voltage to respective ends of the storage capacitor in response to a scan signal;

a driving transistor configured to generate a driving current based on a difference between the first voltage and the second voltage stored in the storage capacitor;

at least one emission transistor configured to selectively provide the driving current to an organic light emitting diode in response to an emission control signal; and the organic light emitting diode configured to emit light based on the driving current, wherein the first voltage is a sum of a data voltage and a pixel deviation compensation voltage for compensating for a threshold voltage deviation between a plurality of pixels comprised in the display panel, wherein the second voltage is a panel deviation compensation voltage for compensating for a threshold voltage deviation between a plurality of display panels manufactured by a same process for the display panel, and wherein the at least one scan transistor comprises:

a first scan transistor configured to transfer the first voltage to a first end of the storage capacitor, which is connected to a gate of the driving transistor, in response to the scan signal; and a second scan transistor configured to transfer the second voltage to a second end of the storage capacitor in response to the scan signal.

9. The pixel of claim 8, wherein the first scan transistor comprises a gate for receiving the scan signal, a drain for receiving the first voltage, and a source connected to the first end of the storage capacitor, and wherein the second scan transistor comprises a gate for receiving the scan signal, a drain for receiving the second voltage, and a source connected to the second end of the storage capacitor.

10. The pixel of claim 8, wherein the at least one emission transistor comprises:

a first emission transistor configured to connect the second end of the storage capacitor to a source of the driving transistor in response to the emission control signal; and a second emission transistor configured to connect a line of a first power supply voltage to a drain of the driving transistor in response to the emission control signal.

11. The pixel of claim 10, wherein the first emission transistor comprises a gate for receiving the emission control signal, a drain connected to the second end of the storage capacitor, and a source connected to the source of the driving transistor, and wherein the second emission transistor comprises a gate for receiving the emission control signal, a drain connected to the line of the first power supply voltage, and a source connected to the drain of the driving transistor.

12. The pixel of claim 8, wherein the at least one emission transistor comprises:

a first emission transistor configured to connect the second end of the storage capacitor to a source of a second emission transistor in response to the emission control signal; and a second emission transistor configured to connect a source of the driving transistor to both a source of the first emission transistor and the organic light emitting diode in response to the emission control signal.

13. The pixel of claim 12, wherein the first emission transistor comprises a gate for receiving the emission control signal, a drain connected to the second end of the storage capacitor, and the source connected to the source of the second emission transistor, and wherein the second emission transistor comprises a gate for receiving the emission control signal, a drain connected to the source of the driving transistor, and the source connected to the source of the first emission transistor and the organic light emitting diode.

14. The pixel of claim 8, wherein the at least one emission transistor comprises:

a first emission transistor configured to connect the second end of the storage capacitor to a source of the driving transistor in response to the emission control signal; and a second emission transistor configured to connect the source of the driving transistor to the organic light emitting diode in response to the emission control signal.

15. The pixel of claim 14, wherein the first emission transistor comprises a gate for receiving the emission control signal, a drain connected to the second end of the storage capacitor, and a source connected to the source of the driving transistor, and wherein the second emission transistor comprises a gate for receiving the emission control signal, a drain connected to the source of the driving transistor, and a source connected to the organic light emitting diode.

16. A display device, comprising:

a display panel comprising a plurality of pixels;

a scan driver configured to apply scan signals to the plurality of pixels;

an emission driver configured to apply emission control signals to the plurality of pixels;

a data driver configured to apply first voltages to the plurality of pixels; and a panel deviation compensation voltage generator configured to apply a second voltage to the plurality of pixels, and comprising:

a compensation voltage level storage block configured to store a voltage level of the second voltage determined when a corresponding one of the display panels is manufactured; and a compensation voltage generation block configured to generate the second voltage having the voltage level stored in the compensation voltage level storage block, wherein each of the first voltages is a sum of a data voltage and a pixel deviation compensation voltage for compensating for a threshold voltage deviation between the pixels, and wherein the second voltage is a panel deviation compensation voltage for compensating for a threshold voltage deviation between display panels manufactured by a same process for the display panel.

17. The display device of claim 16, wherein the panel deviation compensation voltage is a same voltage for the plurality of pixels comprised in the display panel, and wherein the panel deviation compensation voltage for each of the display panels is based on an average value or a median value of a threshold voltage distribution of the each of the display panels.

18. The display device of claim 16, further comprising a sensing circuit configured to sense threshold voltages of the plurality of pixels through a plurality of lines to which the second voltage is applied.

* * * * *